US008544984B2

(12) United States Patent
Kataniwa

(10) Patent No.: US 8,544,984 B2
(45) Date of Patent: Oct. 1, 2013

(54) INKJET PRINTER

(75) Inventor: Yuichi Kataniwa, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 13/344,097

(22) Filed: Jan. 5, 2012

(65) Prior Publication Data

US 2012/0176445 A1 Jul. 12, 2012

(30) Foreign Application Priority Data

Jan. 6, 2011 (JP) ..... 2011-001253
Jun. 30, 2011 (JP) ..... 2011-145363

(51) Int. Cl.
*B41J 2/165* (2006.01)

(52) U.S. Cl.
USPC ..... 347/32

(58) Field of Classification Search
USPC ..... 347/32
See application file for complete search history.

(56) References Cited

U.S. PATENT DOCUMENTS 4,692,778 A * 9/1987 Yoshimura et al. ..... 346/145
5,223,859 A * 6/1993 Yoshimura et al. ..... 347/108
5,416,507 A * 5/1995 Otsuka ..... 347/32
5,670,996 A * 9/1997 Mitani ..... 347/29
5,742,303 A * 4/1998 Taylor et al. ..... 347/36
6,474,774 B1 * 11/2002 Okamoto ..... 347/32
7,393,080 B2 * 7/2008 Ishikawa ..... 347/29
2009/0015627 A1 * 1/2009 Takahashi ..... 347/32
2009/0195593 A1 * 8/2009 Iwanaga ..... 347/32

FOREIGN PATENT DOCUMENTS

JP 2001-018408 A 1/2001
JP 2009-226719 A 10/2009

* cited by examiner

*Primary Examiner* — Matthew Luu
*Assistant Examiner* — Alexander D Shenderov
(74) *Attorney, Agent, or Firm* — Lowe Hauptman & Ham, LLP

(57) ABSTRACT

An inkjet printer has a nozzle cap that keeps the nozzle surface of the inkjet head moisturized, and can keep the nozzle cap moist by means of a simple mechanism. A check processing device incorporating the inkjet printer has an inkjet head, a nozzle cap that covers the nozzle surface of the inkjet head and keeps the nozzle surface moist, and a shutter that closes the open part of the nozzle cap to keep the inside of the nozzle cap moist. When the nozzle surface of the inkjet head is not capped, a moisture retention state in which moisture inside the nozzle cap is prevented from evaporating can be held by the shutter covering the open part of the nozzle cap.

13 Claims, 19 Drawing Sheets

INKJET PRINTER

RELATED APPLICATIONS

The present application is based on, and claims priority from, Japanese Application Number 2011-001253, filed Jan. 6, 2011, the disclosure of which is hereby incorporated by reference herein in its entirety. The present application is also based on Japanese Application Number 2011-145363, filed Jun. 30, 2011, the disclosure of which is hereby incorporated by reference herein in its entirety.

BACKGROUND

1. Technical Field

The present disclosure relates to an inkjet printer having a nozzle cap that covers the nozzle surface in order to keep the nozzle surface of the inkjet head from drying out. The disclosure relates more particularly to an inkjet printer having a cap moisture retention mechanism that keeps the inside of the nozzle cap desirably moist.

2. Related Art

If moisture evaporates from the ink in the nozzles of the inkjet head while the inkjet printer is waiting for the next print job or printer power is off and the ink viscosity increases, ink droplet ejection problems can occur during the next print job. To prevent this, a nozzle cap is placed over the nozzle surface of the inkjet head when not printing to keep the nozzle surface sealed so that moisture does not evaporate, that is, keeps the nozzles from drying out.

While printing with the inkjet head, the nozzle cap is not capping the nozzle surface and is left open. If this condition continues for long, moisture also evaporates from inside the nozzle cap, and viscous ink can build up in the cap. If the nozzle cap then covers the nozzle surface of the inkjet head after printing ends, the glycerine, diethylene glycol, or other moisturizing agent in the high viscosity ink accumulated in the nozzle cap will absorb moisture from inside the nozzles of the inkjet head. This promotes a further increase in ink viscosity inside the nozzles, and can lead to clogged nozzles and ink droplet ejection problems.

To prevent such problems, Japanese Unexamined Patent Appl. Pub. JP-A-2001-18408 and JP-A-2009-226719 teach inkjet recording devices having a moisture retention means that supplies a moisturizing fluid into the nozzle cap, or a cleaning means that supplies a cleaning fluid into the nozzle cap to remove the accumulated viscous ink.

Providing space sufficient to install such a moisture retention means or cleaning means is generally difficult, however, in small inkjet printers. Providing a moisture retention means or cleaning means also increases product cost.

Using inkjet printers to print endorsements on the back of checks, for example, is also conceivable. A stationary inkjet line head could be disposed to a fixed position on the check conveyance path, for example, in order to print on the back of checks conveyed through a check conveyance path.

When an inkjet line head disposed to a fixed position is used, the nozzle cap is disposed opposite the nozzle surface with the check conveyance path or other media conveyance path therebetween, and the nozzle cap must be moved across the media conveyance path to cap the nozzle surface. This can be done by rendering an opening in the media guide or platen that is disposed opposite the nozzle surface of the inkjet head, and moving the nozzle cap to and away from the nozzle surface through this opening.

However, if an opening for moving the nozzle cap in and out is rendered in the media guide, the edge of the media passing thereby could catch on the edge of the opening, and paper jams can easily result. If a paper jam occurs at the printing position where the nozzle surface is positioned to the media path, paper dust may clog the nozzles of the inkjet head, undesirably resulting in ink droplet ejection problems or ink droplets smearing the surface of the conveyed media, for example.

SUMMARY

An inkjet printing device according to the disclosure uses a simple mechanism that requires little space to keep the inside of the nozzle cap, which keeps the nozzle surface of the inkjet head from drying out, from drying out.

An inkjet printing device according to the disclosure can also prevent media jams caused by an opening that is formed in a media guide for advancing and retracting a cap disposed opposite the nozzle surface of the inkjet head with the media conveyance path therebetween.

An inkjet printing device according to one aspect of the disclosure has an inkjet head; a media conveyance path in which a recording medium is passed by a printing position of the inkjet head; a nozzle cap that moves from a retracted position opposite a nozzle surface of the inkjet head with the media conveyance path therebetween, and advances across the media conveyance path to the nozzle surface side to a capping position covering the nozzle surface to hold the nozzle surface in a moisture retention state; and a shutter that closes the open part of the nozzle cap to keep the inside of the nozzle cap in a moisture retention state; wherein the shutter can move in the media conveyance direction of the media conveyance path from a contact position that can contact the open part of the nozzle cap advancing from the retracted position to the capping position, to a non-contact position where there is no contact with the open part, and the nozzle cap contacts the shutter in the contact position at an intermediate position during advancement from the retracted position to the capping position, the open part of the nozzle cap is closed, and the moisture retention state is formed.

When the nozzle surface of the inkjet head is not capped, the opening to the nozzle cap is covered by a shutter, thereby preventing evaporation of moisture from inside the nozzle cap. The inside of the nozzle cap can therefore be held in an appropriately moist state without using a moisture retention means or cleaning means. Furthermore, a moisturizing fluid or cleaning fluid tank, a supply mechanism for supplying the moisturizing fluid or cleaning fluid from the tank, and a recovery mechanism for recovering moisturizing fluid or cleaning fluid from the nozzle cap must be provided when a moisture retention means or cleaning means are used. However, the embodiments of the disclosure only need a shutter and a simple mechanism for moving the shutter, and can therefore be easily used in a small inkjet printer.

In addition, because the shutter simply slides in the media conveyance direction, the mechanism for driving the shutter can be simply constructed and requires little space.

When the nozzle cap is disposed opposite the inkjet head nozzle surface with the media conveyance path therebetween, a media guide opening is formed in the media guide opposite the inkjet head nozzle surface so that the nozzle cap can advance to and retract from the nozzle surface of the inkjet head. In this case, the shutter can be used to close the media guide opening. When in the closed position, the shutter can also be used as a portion of the media guide that guides the recording medium.

If media is conveyed while the media guide opening is exposed to the media conveyance path, the edge of the media can easily catch on the edge of the media guide opening and easily cause a paper jam at the printing position of the inkjet head. Such problems can be reliably prevented by closing the media guide opening with the shutter and using the shutter to guide the media. In addition, because the shutter functions as a cover for keeping the nozzle cap moist, a cover for closing the media guide opening, and a media guide (platen) that guides the media passed by the printing position, the construction is much simpler than a configuration using multiple different members, less space is needed, and increases in the production cost can be suppressed.

When the width of the media conveyance path is vertically oriented, the nozzle surface of the inkjet head is also oriented vertically, and the open part of the nozzle cap for capping the nozzle surface is also long vertically. Because moisture moves easily down inside the nozzle cap due to gravity, the top part in particular dries easily if moisture evaporates from inside the nozzle cap. Because the described embodiments close the opening to the nozzle cap with a shutter, evaporation of moisture can be prevented, and the top part of the inside of the nozzle cap can be prevented from drying out.

An inkjet printer according to another aspect of the disclosure preferably also has a drive control mechanism that performs a nozzle capping operation using the nozzle cap and a nozzle cap closing operation using the shutter, holds the shutter in the non-contact position when the nozzle cap is in the capping position and when the nozzle cap is moving from the capping position to the retracted position, moves the shutter from the non-contact position to the contact position when the nozzle cap returns to the retracted position, and when the shutter is in the contact position, advances the nozzle cap to the position contacting the shutter and forms the closed state of the nozzle cap.

This drive control mechanism preferably has a drive motor, a nozzle cap drive mechanism having a cylindrical cam that converts output rotation of the drive motor to a linear reciprocating motion of the nozzle cap between the retracted position and the capping position, and a shutter drive mechanism having an intermittent gear and a rack and pinion that convert rotation of the cylindrical cam to a linear reciprocating motion of the shutter from the contact position to the non-contact position according to the position of nozzle cap movement.

Another aspect of the disclosure is a control method of an inkjet printing device that has an inkjet head, a media conveyance path that conveys a recording medium passed a printing position of the inkjet head, a nozzle cap that moves from a retracted position opposite a nozzle surface of the inkjet head with the media conveyance path therebetween, and advances across the media conveyance path to the nozzle surface side to a capping position covering the nozzle surface to hold the nozzle surface in a moisture retention state, and a shutter that closes the open part of the nozzle cap to keep the inside of the nozzle cap in a moisture retention state. The control method has steps of: moving the shutter in the media conveyance direction of the media conveyance path from a contact position that can contact the open part of the nozzle cap advancing from the retracted position to the capping position, to a non-contact position where there is no contact with the open part; and causing the nozzle cap to contact the shutter in the contact position at an intermediate position in advancement from the retracted position to the capping position so that the open part of the nozzle cap is closed and a moisture retention state is formed.

A control method for an inkjet printer according to another aspect of the disclosure preferably also has a drive control mechanism that performs a nozzle capping operation using the nozzle cap and a nozzle cap closing operation using the shutter, and the drive control mechanism holds the shutter in the non-contact position when the nozzle cap is in the capping position and when the nozzle cap is moving from the capping position to the retracted position, moves the shutter from the non-contact position to the contact position when the nozzle cap returns to the retracted position, and when the shutter is in the contact position, advances the nozzle cap to the position contacting the shutter to forms the closed state of the nozzle cap.

When the nozzle surface of the inkjet head is not capped, the inkjet printer control method according to this aspect of the disclosure covers the opening to the nozzle cap with a shutter, thereby preventing evaporation of moisture from inside the nozzle cap. The inside of the nozzle cap can therefore be held in an appropriately moist state without using a moisture retention means or cleaning means.

Other objects and attainments together with a fuller understanding of the disclosure will become apparent and appreciated by referring to the following description and claims taken in conjunction with the accompanying drawings.

DESCRIPTION OF EMBODIMENTS

A preferred embodiment of an inkjet printer according to the present disclosure is described below with reference to the accompanying figures. The embodiment described below applies the disclosure to a check processing device, but it will be obvious to one with ordinary skill in the related art that the described embodiments can also be applied to inkjet printers that print on media other than checks.

General Configuration

Figure 1:
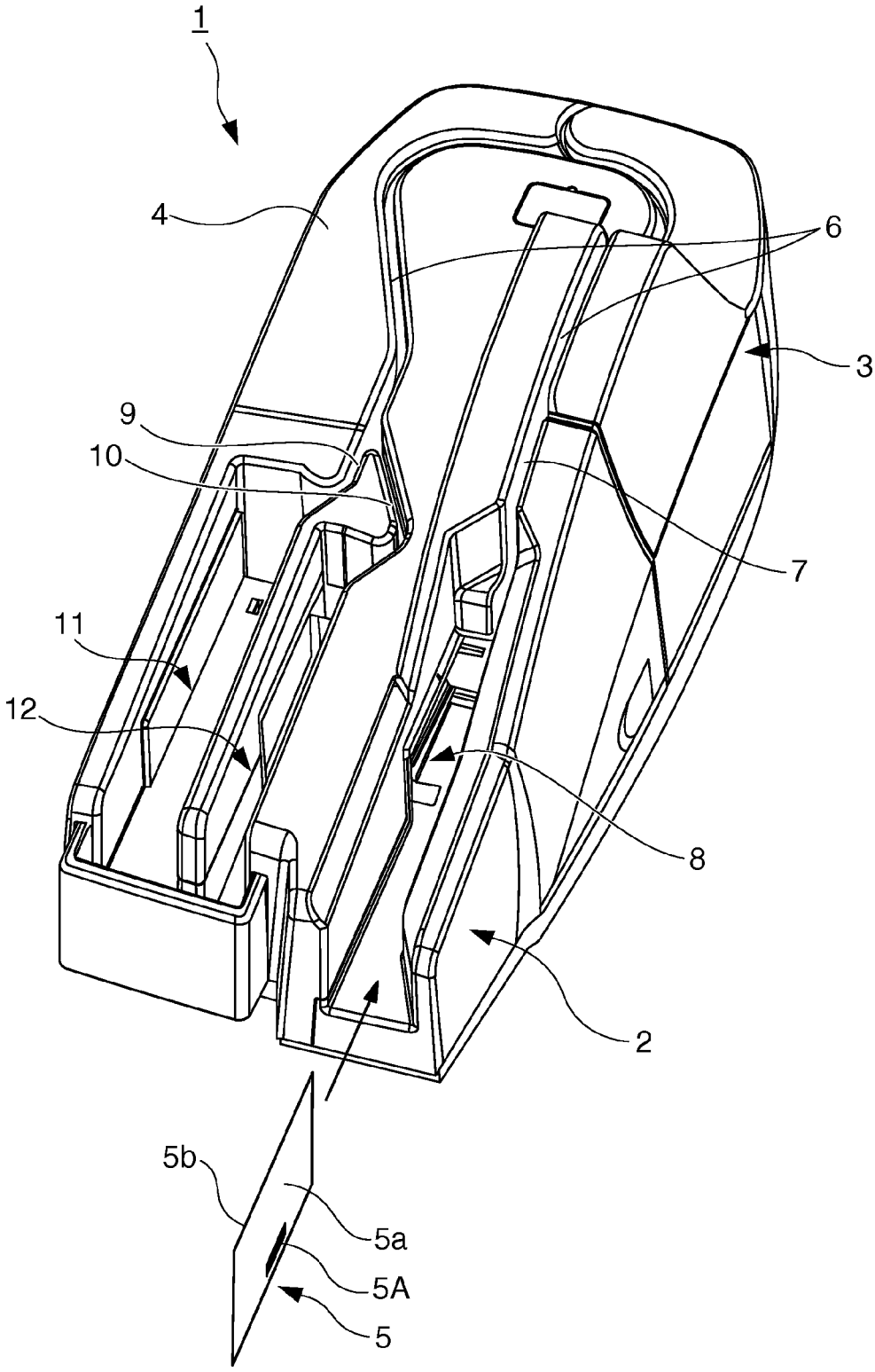
FIG. 1 is an external oblique view of a check processing device according to at least one embodiment.
Figure 2:
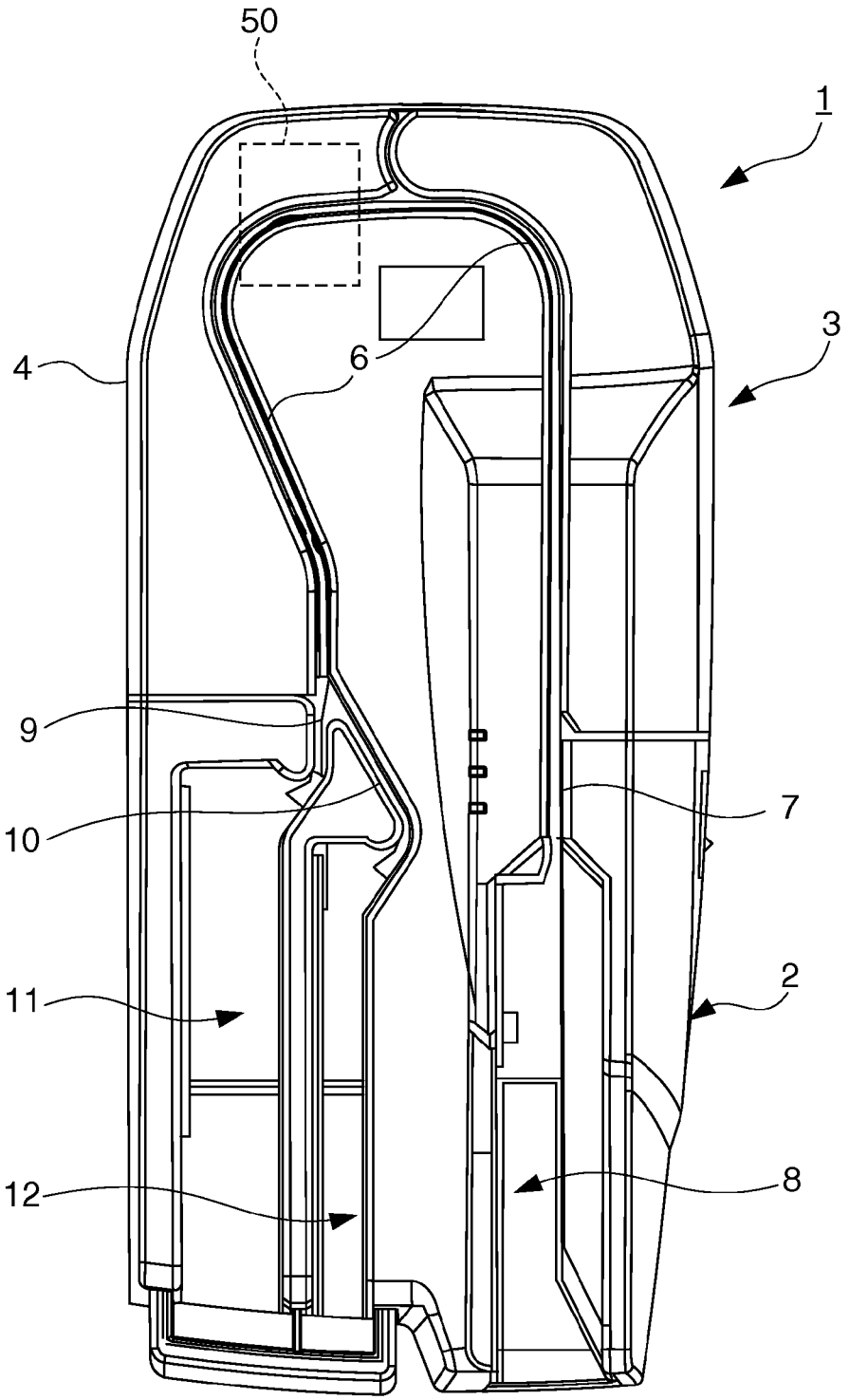
FIG. 2 is a plan view of the check processing device shown in FIG. 1.

FIG. 1 is an external oblique view of a check processing device according to this embodiment of the disclosure, and FIG. 2 is a plan view of the same.

The check processing device 1 includes a main case 2, and right and left access covers 3 and 4 that open and close. A check conveyance path (media conveyance path) 6 for conveying a check 5 as the recording medium is formed between the main case 2 and the access covers 3 and 4. The check conveyance path 6 is a vertical channel of a specific depth that is open to the top of the check processing device 1, and curves in a basic U-shape when seen in plan view. A check 5 is conveyed through the check conveyance path 6 standing on edge with the long sides at top and bottom.

A check in-feed path 7, which is a narrow vertical channel similar to the check conveyance path 6, is disposed to the check conveyance path 6 at the upstream end in the check conveyance direction, and a check supply unit 8, which is a wide vertical channel, is disposed at the upstream end of the check in-feed path 7. Disposed to the downstream end of the check conveyance path 6 are a first check discharge unit 11 and a second check discharge unit 12. The first check discharge unit 11 is a wide vertical channel that communicates with the check conveyance path 6 through a diversion channel 9, which is a narrow vertical path similar to the check conveyance path 6. The second check discharge unit 12 is also a wide vertical channel and communicates with the check conveyance path 6 through another diversion channel 10, which is also a narrow vertical path.

An MICR line 5A is printed along the length of the check 5 at the bottom of the face 5*a*. Also written against a specific background on the face 5*a* are the check amount, payer, check number, and signature. A watermark to prevent forgery and an endorsement line are printed on the back 5*b* of the check. In this example the check 5 is inserted to the check supply unit 8 with the face 5*a* facing the outside of the U-shaped check conveyance path 6.

A check 5 inserted to the check supply unit 8 is fed from the check in-feed path 7 to the check conveyance path 6. While the check 5 is conveyed through the check conveyance path 6, scanners (not shown in the figure) disposed on both sides of the check conveyance path 6 read the MICR line 5A printed on the face 5*a* and image the face, and image the watermark printed on the back and the endorsement line. The bank account number and other information is printed on the back of the check 5 by the print unit 50 disposed to the U-shaped curved part of the check conveyance path 6. After the check information is read and the check is printed, the check is discharged into the first check discharge unit 11. If the check cannot be read or a read error occurs, the check 5 is not printed by the print unit 50 and is discharged into the second check discharge unit 12.

Figure 3:
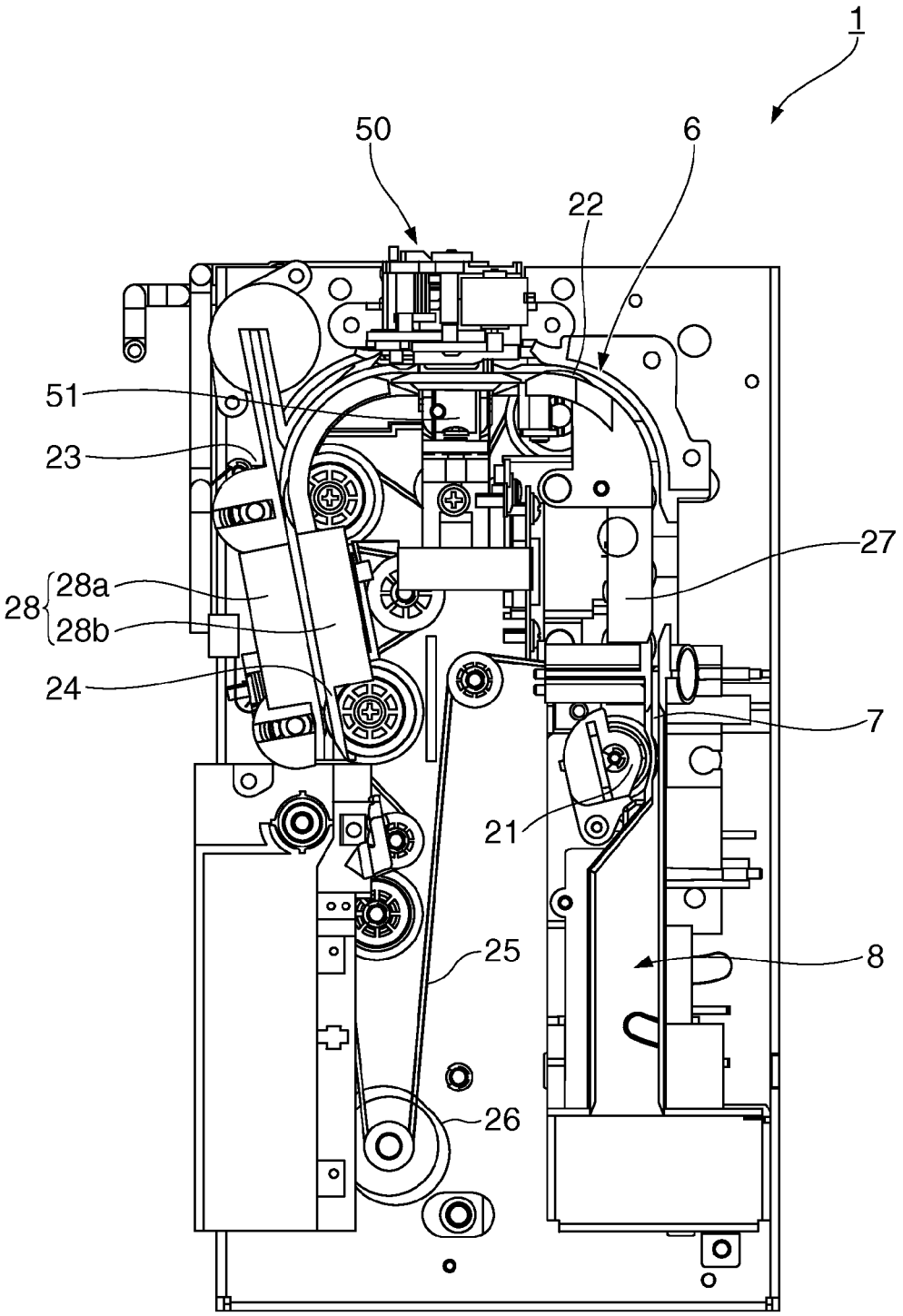
FIG. 3 schematically describes the internal construction of the check processing device shown in FIG. 1.

FIG. 3 shows the internal construction of the check processing device 1. Parts disposed along the check conveyance path are described next with reference to this figure. A paper feed roller and pressure member not shown are disposed on opposite sides of the check supply unit 8. Checks 5 stored standing on edge in the check supply unit 8 are delivered by the paper feed roller into the check in-feed path 7. A sheet feeder including a paper feed roller 21 and a retard roller not shown is disposed to the check in-feed path 7 for feeding the supplied checks 5 one at a time into the check conveyance path 6.

A plurality of conveyance rollers including conveyance roller pairs 22 to 24 are disposed to the check conveyance path 6 at the conveyance portion downstream from the paper feed roller 21, and the checks 5 are conveyed by these conveyance roller pairs 22 to 24 through the check conveyance path 6 toward the check discharge units 11 and 12. The conveyance roller pairs 22 to 24 are rotationally driven synchronously by a drive motor 26 by means of an intervening endless belt 25.

A magnetic reading unit 27 is disposed to the conveyance path portion on the upstream side of the check conveyance path 6. The magnetic reading unit 27 has a magnetic scanner such as an MICR unit that can read the MICR line 5A printed with magnetic ink on the checks 5. The print unit 50 that prints an endorsement, for example, on the back of the check 5 is disposed to a position on the upstream side of the conveyance path portion where the check conveyance path 6 curves to the left side of the printer. As further described below with reference to FIG. 4 to FIG. 10, the print unit 50 has a line-type inkjet head 51 disposed vertically to the printer so that the nozzle surface 51A of the inkjet head 51 faces the check conveyance path 6.

An optical scanner 28 that images both sides of the check 5 is disposed to the check conveyance path 6 between conveyance roller pairs 23 and 24. The optical scanner 28 includes a front scanner 28*a* for imaging the front of the check, and a back scanner 28*b* for imaging the back, with the scanning surfaces thereof facing each other with the check conveyance path 6 therebetween.

Print Unit

Figure 4:
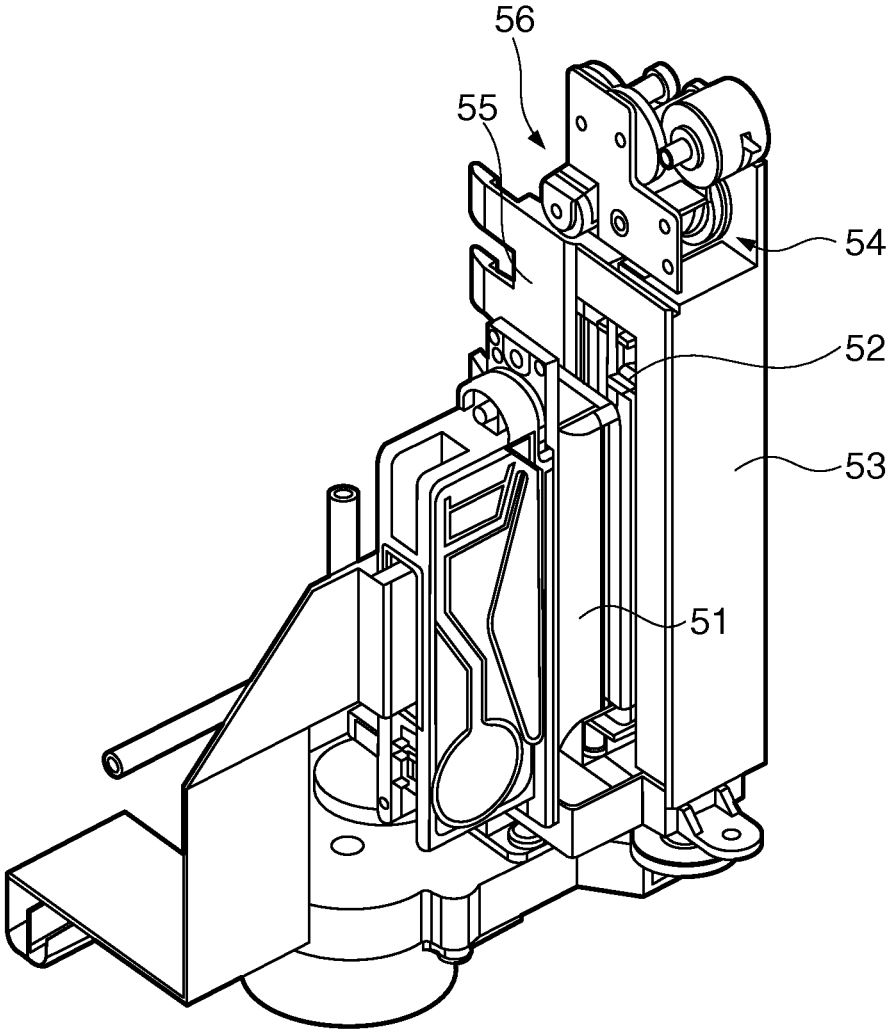
FIG. 4 describes the print unit of the check processing device shown in FIG. 1.

FIG. 4 describes the part of the print unit 50 around the inkjet head and nozzle cap. The print unit 50 includes the inkjet head 51, a nozzle cap 52 that seals the nozzle surface 51A of the inkjet head 51, a nozzle cap storage unit 53 where the nozzle cap 52 is stored, and a shutter 55 that closes the open part of the nozzle cap 52.

The nozzle cap 52 is driven by a nozzle cap drive mechanism 54, and moves bidirectionally as described below between a retracted position where the nozzle cap 52 is housed in the nozzle cap storage unit 53, and a capping position where the nozzle surface 51A of the inkjet head 51 is sealed.

The shutter 55 is driven by a shutter drive mechanism 56, and moves bidirectionally as described below between a closed position where it closes the open part of the nozzle cap storage unit 53 (a contact position where the opening in the nozzle cap 52 can be closed), and an open position (non-contact position).

Figure 7:
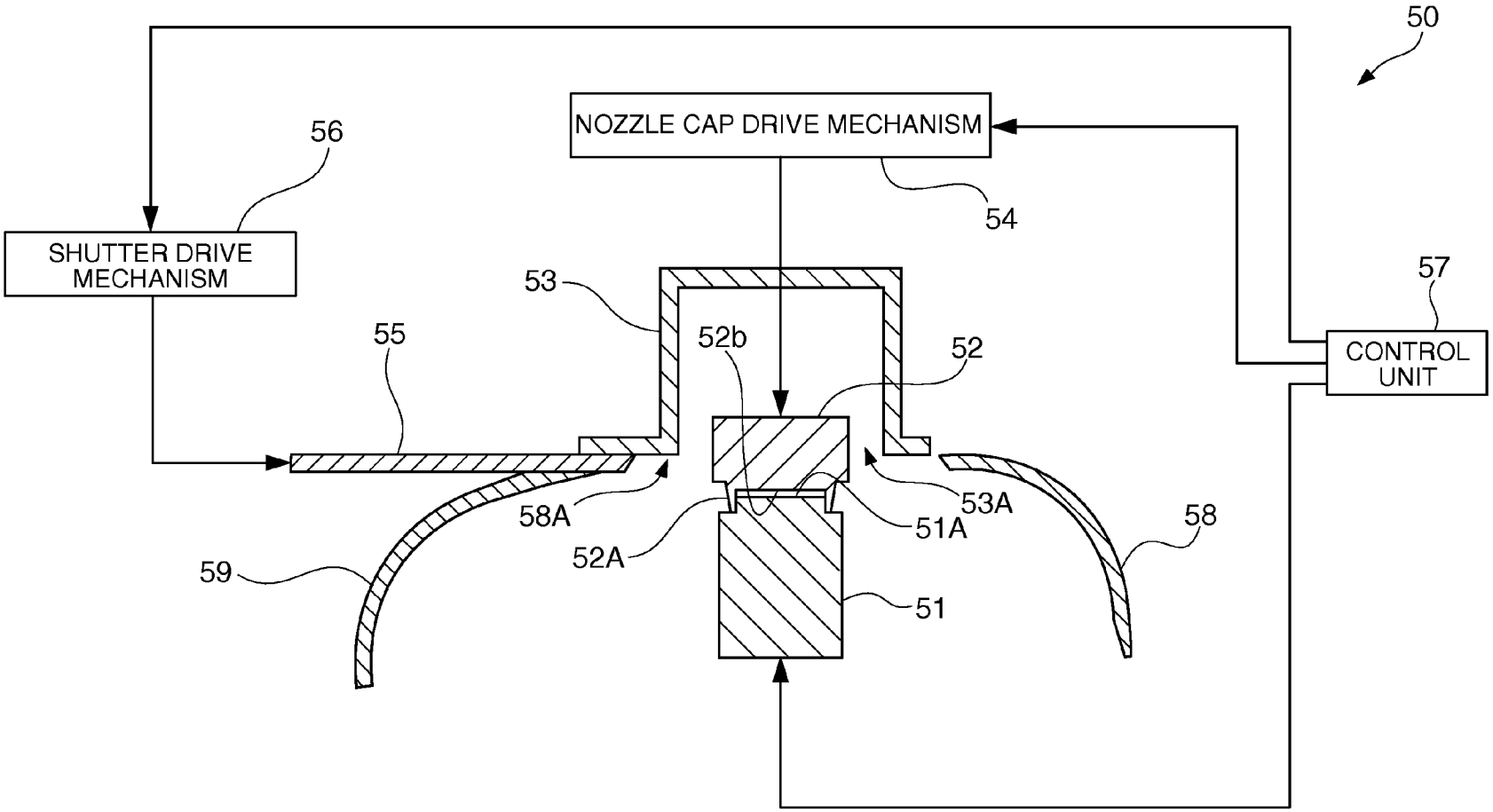
FIG. 7 describes when the nozzle cap covers the nozzle surface of the inkjet head.
Figure 8:
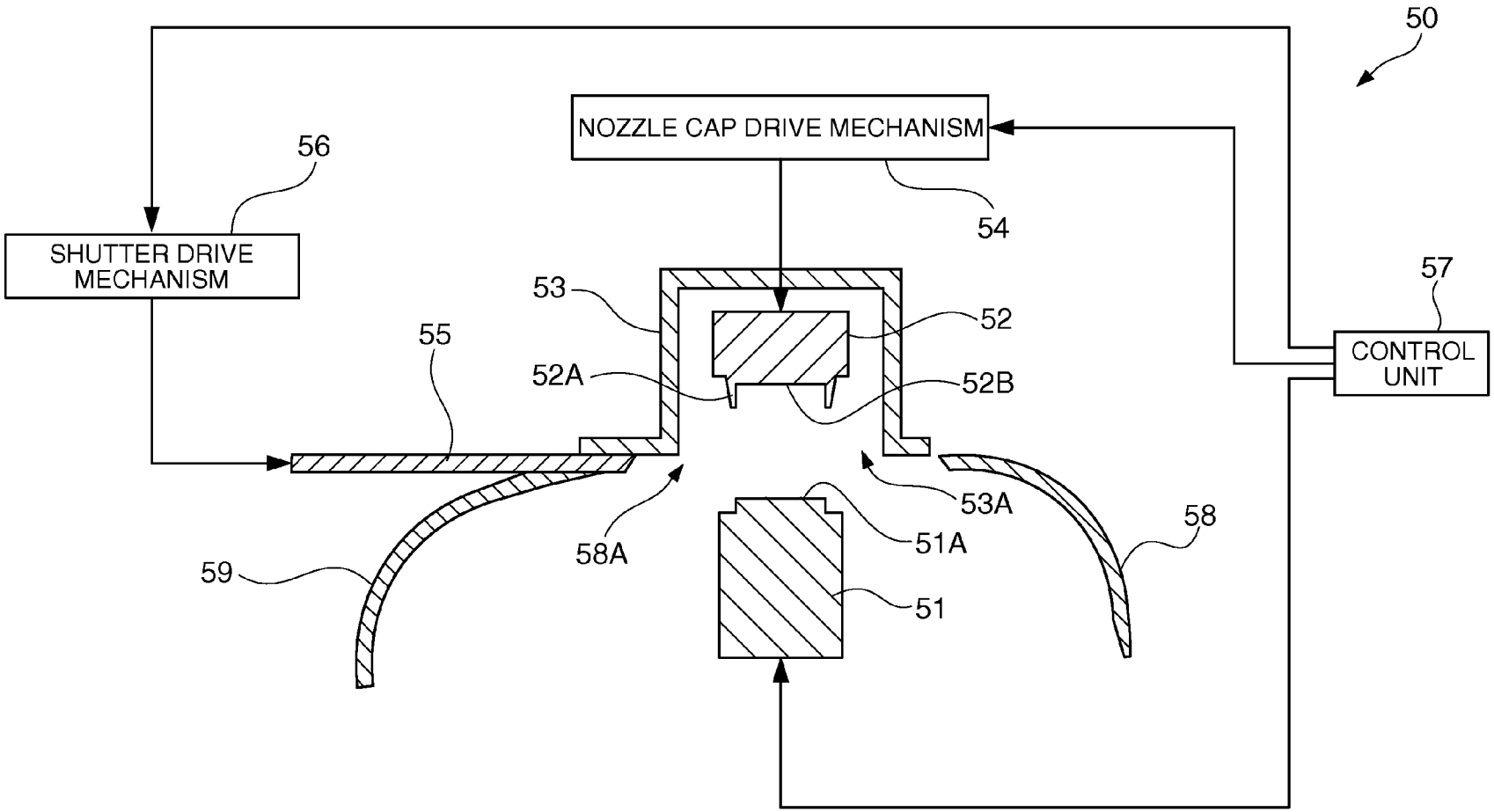
FIG. 8 describes the nozzle cap in the retracted position.
Figure 9:
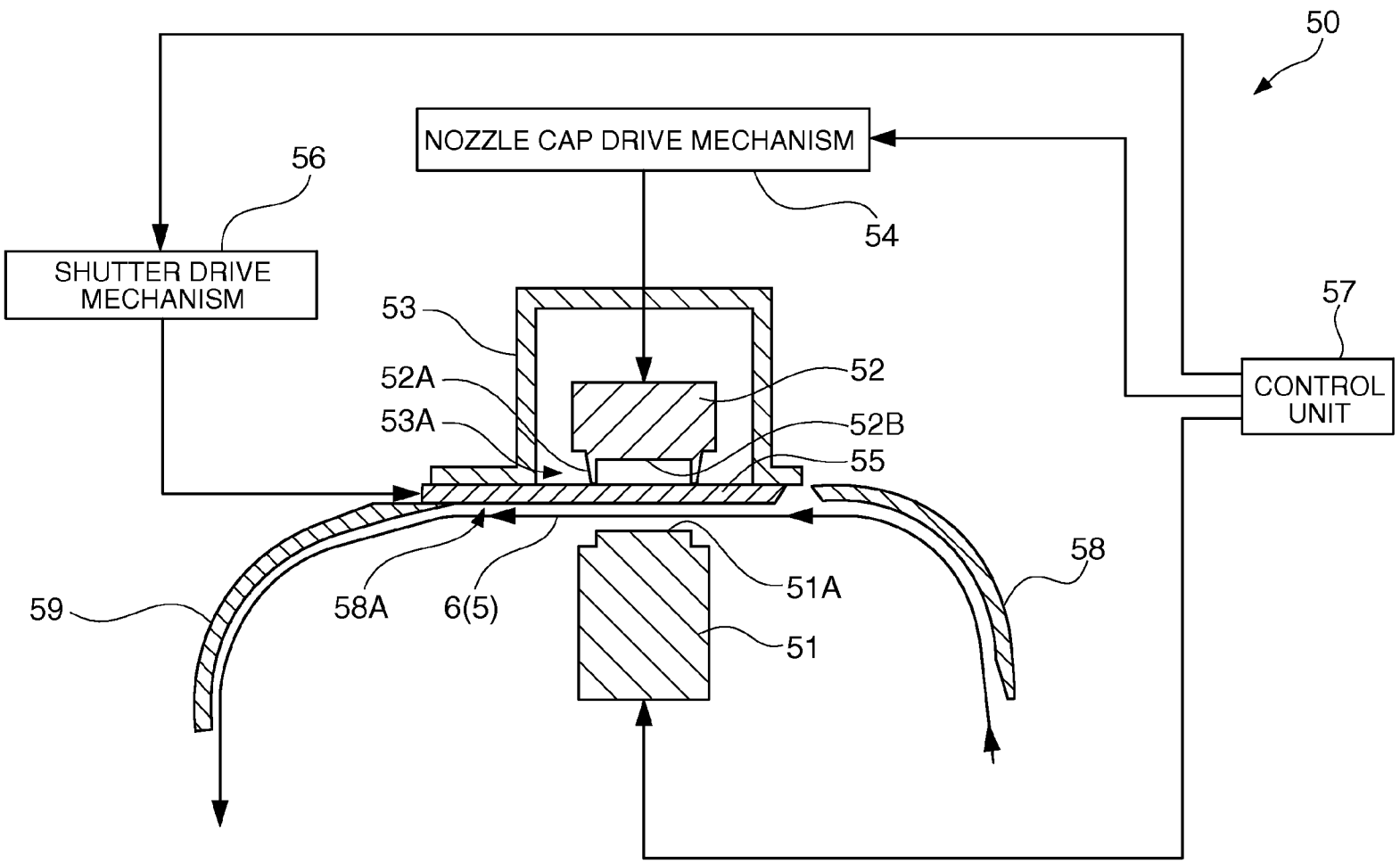
FIG. 9 describes when the nozzle cap is closed by the shutter.

Movement of the nozzle cap 52 and shutter 55 by means of the nozzle cap drive mechanism 54 and shutter drive mechanism 56 is controlled by a control unit 57 (FIG. 7 to FIG. 9).

Figure 5:
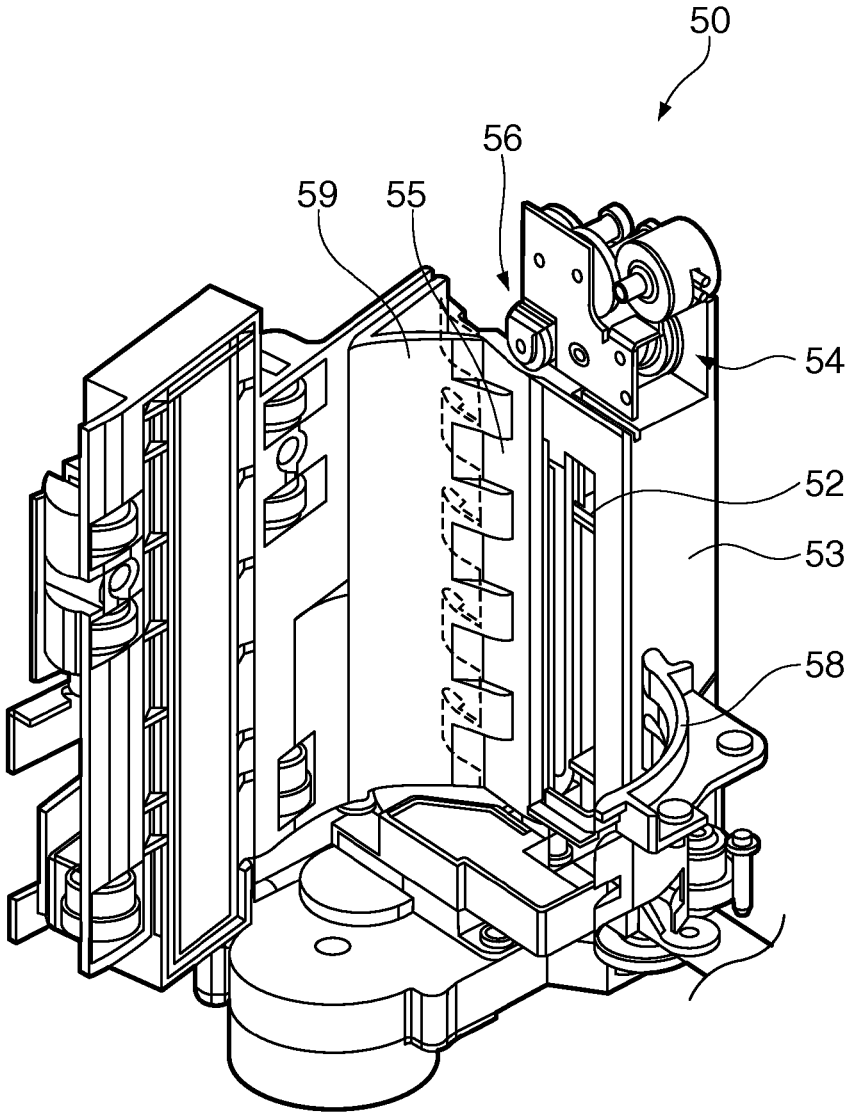
FIG. 5 describes the print unit is in the open position (non-contact position).
Figure 6:
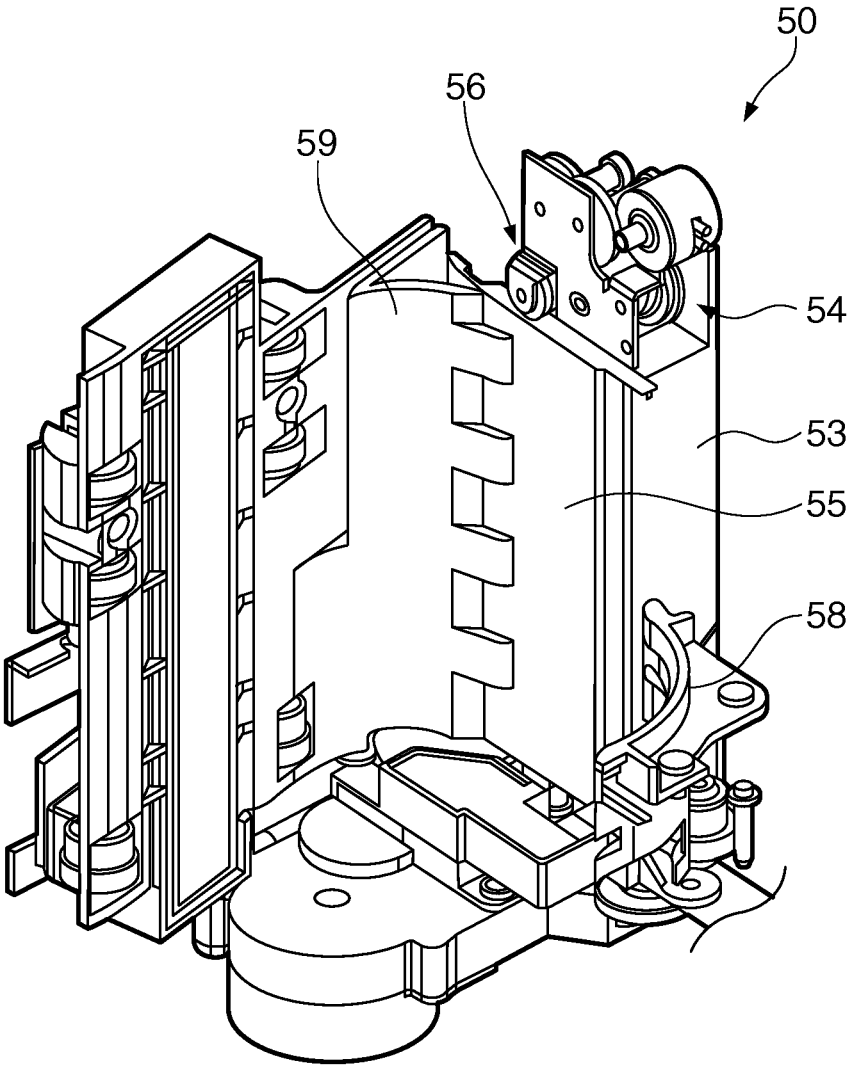
FIG. 6 describes the print unit is in the closed position (contact position).

FIG. 5 shows the print unit 50, omitting the inkjet head 51, when the shutter 55 is in the open position (non-contact position), and FIG. 6 shows the print unit 50, omitting the inkjet head 51, when the shutter 55 is in the closed position (contact position). FIG. 7 shows the nozzle surface 51A of the inkjet head 51 when sealed by the nozzle cap 52, FIG. 8 shows the nozzle cap 52 in the retracted position, and FIG. 9 shows when the shutter 55 moved to the closed position covers the nozzle cap 52 opening and functions as a guide that guides the check 5.

The parts and operation of the print unit 50 are described next with reference to the figures.

The inkjet head 51 is disposed with the nozzle surface 51A facing the printing surface of the check 5 conveyed through the check conveyance path 6. The inkjet head 51 is a line inkjet head, and prints on the printing surface by ejecting ink droplets onto the printing surface of the check 5 from a plurality of nozzles formed in the nozzle surface 51A based on supplied print data.

The nozzle cap 52 is disposed in the nozzle cap storage unit 53 with the open part 52B opposite the nozzle surface 51A of the inkjet head 51.

The nozzle cap storage unit 53 has an opening 53A on the check conveyance path 6 side, and the nozzle cap 52 protrudes through this opening 53A in the direction approaching the nozzle surface 51A and caps the nozzle surface 51A. In other words, the nozzle cap 52 can move by means of drive power from the nozzle cap drive mechanism 54 in the direction in which the open part 52B separates from the nozzle surface 51A of the inkjet head 51 and in the direction approaching the nozzle surface 51A. The part of the opening 53A of the nozzle cap storage unit 53 opposite the nozzle surface 51A of the inkjet head 51 on the check conveyance path 6 is a guide opening 58A (media guide opening), and the opening 53A of the nozzle cap storage unit 53 is positioned here. A stationary upstream guide 58 is disposed to the upstream side of the guide opening 58A, and a stationary downstream guide 59 is disposed on the downstream side.

When the check processing device 1 power is off, or until the printing operation of the print unit 50 starts after the power turns on, the nozzle cap 52 is in the capping position shown in FIG. 7. The nozzle surface 51A of the inkjet head 51 is sealed by the nozzle cap 52 in this position and kept moist.

When the printing operation of the print unit 50 starts, the nozzle cap 52 retracts from the capping position to the retracted position shown in FIG. 8. Then, as shown in FIG. 9, the shutter 55 slides to the closed position closing the opening 53A of the nozzle cap storage unit 53 and the guide opening 58A, and the nozzle cap 52 advances until it contacts the back of the shutter 55. The nozzle cap 52 is thus sealed.

When a specific time passes in the standby state waiting for the next check 5 to be conveyed after the print unit 50 finishes printing a check 5, or check processing device 1 operation stops because the power was turned off, for example, the nozzle cap 52 moves to the capping position shown in FIG. 7 again and seals the nozzle surface 51A of the inkjet head 51.

Because the open part 52B of the nozzle cap 52 contacts the back of the shutter 55 while printing a check 5, the inside of the nozzle cap 52 is closed to the outside by the shutter 55. More specifically, the shutter 55 functions as a cap cover that seals the open part 52B of the nozzle cap 52 and holds moisture inside the nozzle cap 52. Evaporation of moisture from ink droplets ejected from the inkjet head 51 is thus prevented in the nozzle cap 52.

As shown in FIG. 9, the shutter 55 also functions when in the closed position as a shield member that closes the guide opening 58A and the opening 53A of the nozzle cap storage unit 53 between the stationary upstream guide 58 and the stationary downstream guide 59, and as a paper path part (media guide) that smoothly spans the gap between these guides 58 and 59. Paper jams, for example, thus do not occur easily, and media can be conveyed smoothly.

Note that the shutter 55 can also move in the direction toward the nozzle cap 52, contact the open edge 52A of the nozzle cap 52, and close the nozzle cap 52.

Figure 10:
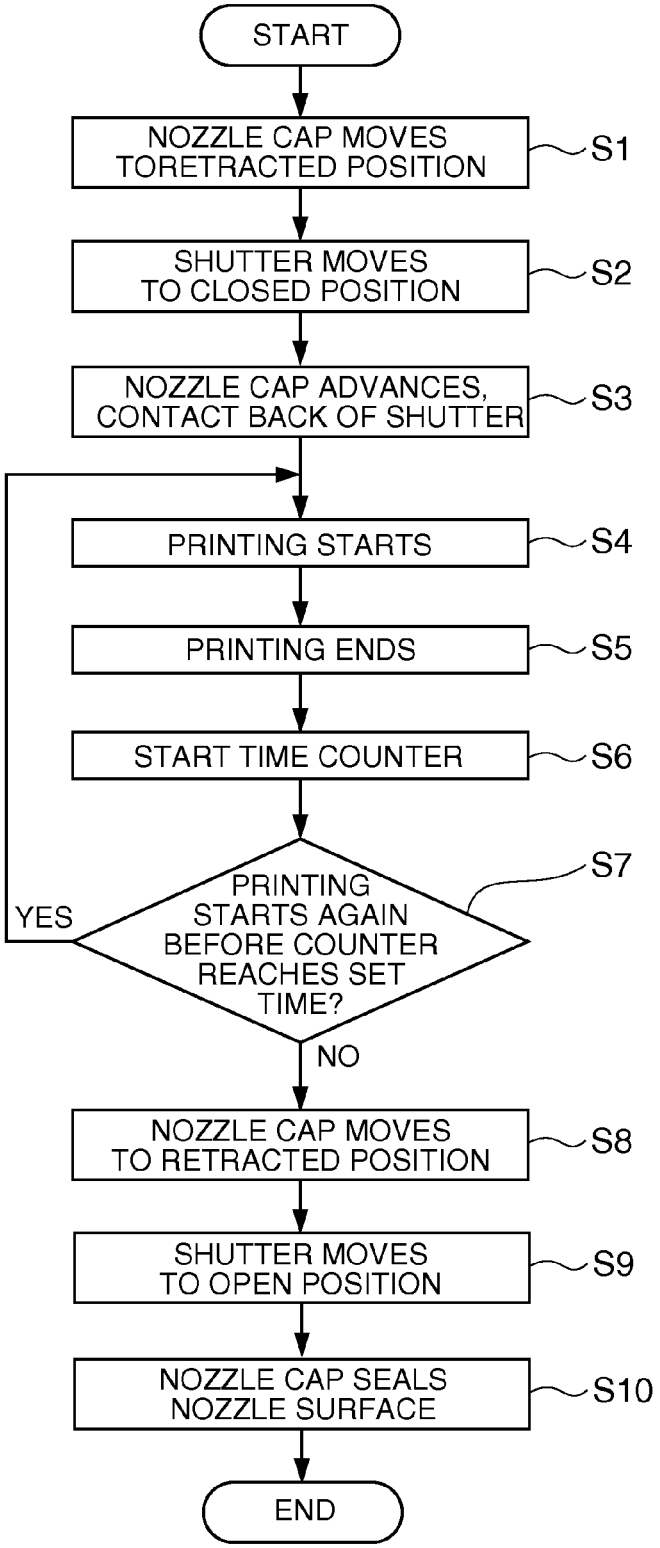
FIG. 10 is a flow chart of nozzle cap and cap cover operation.

FIG. 10 is a flow chart of the printing operation controlled by the control unit 57, and focuses on the operation of the nozzle cap 52 and shutter 55 of the print unit 50.

When printing starts, the nozzle cap drive mechanism 54 moves the nozzle cap 52 from the capping position shown in FIG. 7 to the retracted position shown in FIG. 8 (step S1).

After the shutter drive mechanism 56 then slides the shutter 55 to the closed position (contact position) (step S2), the nozzle cap drive mechanism 54 moves the nozzle cap 52 from the retracted position to the position where the open edge 52A of the open part 52B contacts the back of the shutter 55 (step S3). Printing the check 5 then starts (step S3).

When printing the check 5 ends (step S5), the control unit 57 counts the time from the end of printing (step S6). If printing starts again before the counted time reaches a preset time (step S7 returns Yes), the time count is reset and check 5 printing starts again (step S4).

If the time count reaches the preset time (step S7 returns No), the nozzle cap 52 is moved by the nozzle cap drive mechanism 54 from the position contacting the back of the shutter 55 (FIG. 9) to the retracted position (FIG. 8) (step S8), and the shutter drive mechanism 56 slides the shutter 55 from the closed position (contact position) to the open position (non-contact position) (step S9). Next, the nozzle cap drive mechanism 54 advances the nozzle cap 52 from the retracted position to the capping position, and the nozzle surface 51A is sealed by the nozzle cap 52 (step S10).

In the check processing device 1 according to this embodiment of the disclosure, the shutter 55 can thus seal the open part 52B of the nozzle cap 52 when the nozzle cap 52 is not capping the nozzle surface 51A of the inkjet head 51. As a result, the inside of the nozzle cap 52 is not exposed to air for a long time, and evaporation of moisture from inside the nozzle cap 52 can be prevented.

Nozzle Cap Drive Mechanism and Shutter Drive Mechanism

Figure 11:
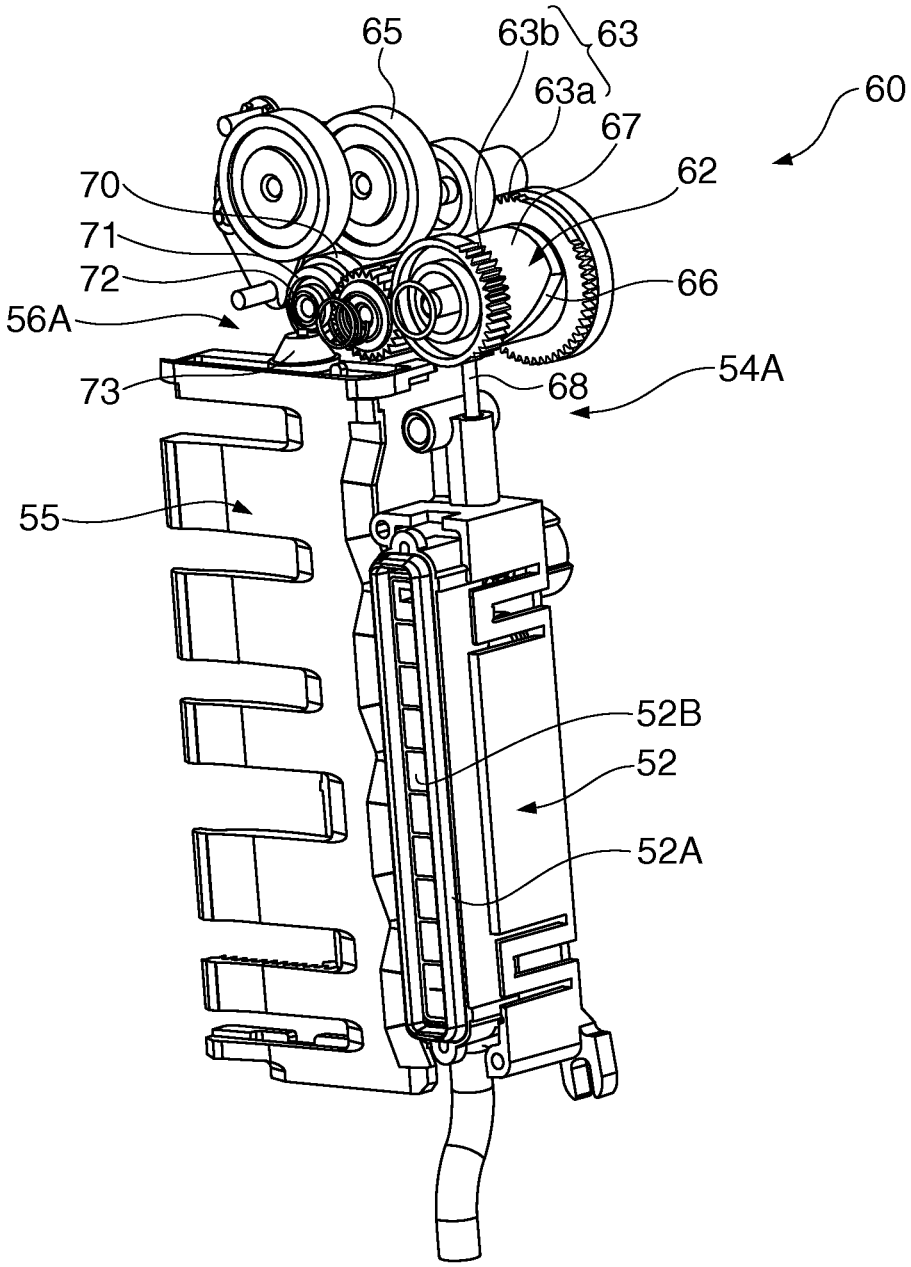
FIG. 11 describes the nozzle cap drive mechanism and shutter drive mechanism.
Figure 12:
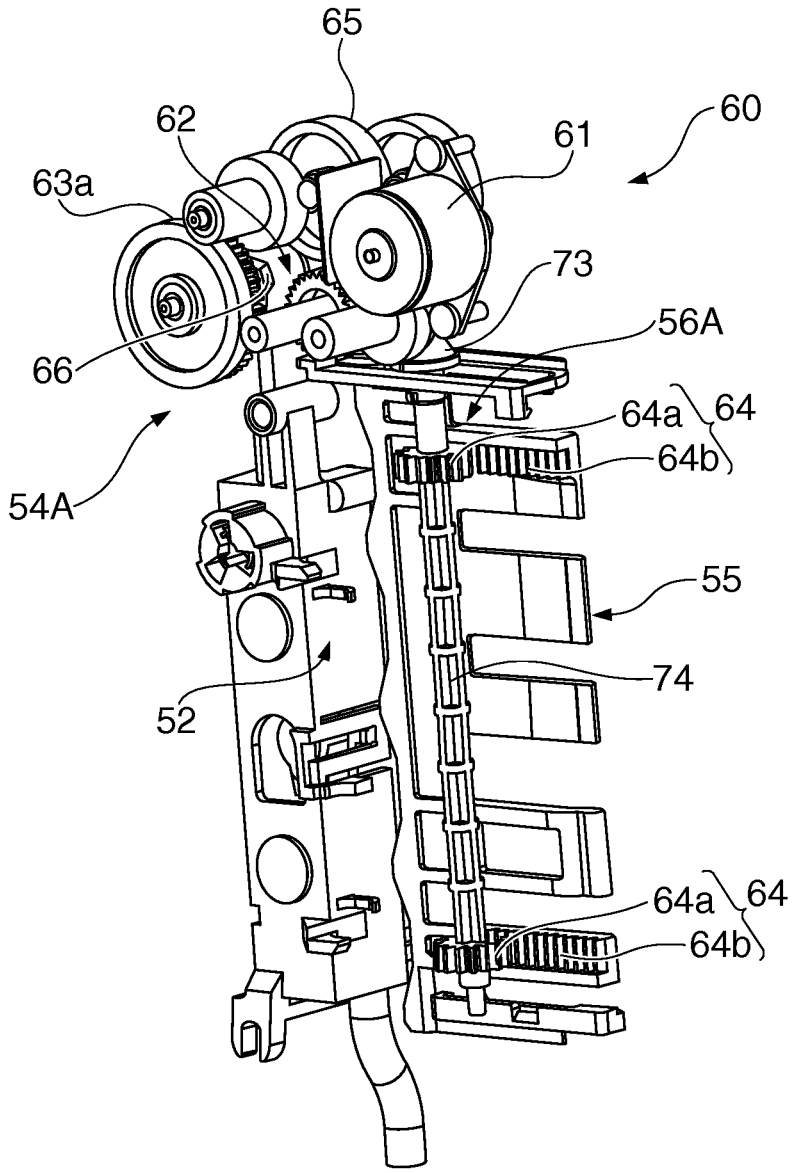
FIG. 12 shows the mechanisms in FIG. 11 from the back.

FIG. 11 shows an example of a drive control mechanism for driving the nozzle cap 52 and shutter 55, and shows the nozzle cap 52 in the capping position and the shutter 55 in the open position (non-contact position). FIG. 12 shows the drive control mechanism shown in FIG. 11 from the opposite side of the check conveyance path 6.

The drive control mechanism 60 includes a nozzle cap drive mechanism 54A and shutter drive mechanism 56A.

The nozzle cap drive mechanism 54A includes a drive motor 61, and a cylindrical cam 62 that converts the output rotation of the drive motor 61 to a linear reciprocating motion between the retracted position and the capping position of the nozzle cap 52.

The shutter drive mechanism 56A includes an intermittent gear 63 and a rack and pinion 64 that convert rotation of the cylindrical cam 62 to a linear reciprocating motion moving the shutter 55 between the closed position (contact position) and the open position (non-contact position).

Under the control of the control unit 57, the drive control mechanism 60 executes the nozzle capping operation of the nozzle cap 52, closes the opening 53A of the nozzle cap storage unit 53 by means of the shutter 55, and closes the nozzle cap by means of the shutter 55 as described below.

The shutter 55 is first held in the open position while the nozzle cap 52 is in the capping position, and until the nozzle cap 52 moves from the capping position to the retracted position. When the nozzle cap 52 returns to the retracted position, the shutter 55 moves from the open position to the closed position and closes the opening 53A of the nozzle cap storage unit 53. When the shutter 55 is in the closed position, the nozzle cap 52 advances to the position in contact with the back of the shutter 55, thereby closing the nozzle cap 52.

More specifically, the nozzle cap drive mechanism 54A has a speed-reducing gear train 65 that speed reduces and transfers the output rotation of the drive motor 61 to the cylindrical cam 62.

The cylindrical cam 62 has a cylindrical part 67 that is disposed horizontally and has a cam groove 66 formed circumferentially in the outside surface thereof; a large diameter intermittent gear 63*a* formed integrally with and coaxially to one end of the cylindrical part 67; and a small diameter intermittent gear 63*b* formed integrally with and coaxially to the other end of the cylindrical part 67. The intermittent gears 63*a* and 63*b* are gears with a toothless portion where external teeth are not formed in a specific angular range.

A vertical pin 68 that extends vertically from below and functions as a cam follower is slidably inserted to the cam groove 66 of the cylindrical cam 62. The pin 68 is formed integrally with the top surface of the nozzle cap 52, and the nozzle cap 52 is supported by the nozzle cap storage unit 53 not shown so that the nozzle cap 52 can reciprocate linearly in the direction of the center axis of the cylindrical cam 62. When the cylindrical cam 62 turns, the pin 68 inserted to the cam groove 66 moves along the center axis of the cylindrical cam 62, and the nozzle cap 52 to which the pin 68 is attached moves in the same direction. The cam groove 66 of the cylindrical cam 62 is formed so that the nozzle cap 52 moves between the retracted position where the nozzle cap storage unit 53 is stored to the capping position.

The shutter drive mechanism 56A has a transfer gear train 70 that meshes with the small diameter intermittent gear 63*b* of the cylindrical cam 62. A driver-side bevel gear 72 is coaxially attached to the last gear 71 of the transfer gear train 70, and a driven bevel gear 73 that rotates on a vertical axis meshes with the driver-side bevel gear 72. A vertical shaft 74 to the top end of which the driven bevel gear 73 is attached extends vertically on the back side of the shutter 55. A pair of pinions 64*a* are attached coaxially to the top and bottom end parts of the vertical shaft 74. These pinions 64*a* mesh with a pair of racks 64*b* formed on the back of the shutter 55.

When the cylindrical cam 62 turns and the nozzle cap 52 moves, the pinions 64*a* rotate in a specific direction in a specific synchronization with the nozzle cap 52, and the racks 64*b* reciprocate linearly along the check conveyance path 6. The shutter 55 on which the racks 64*b* are formed also reciprocates linearly between the closed position where the shutter 55 closes the opening 53A of the nozzle cap storage unit 53, and the open position.

Figure 13:
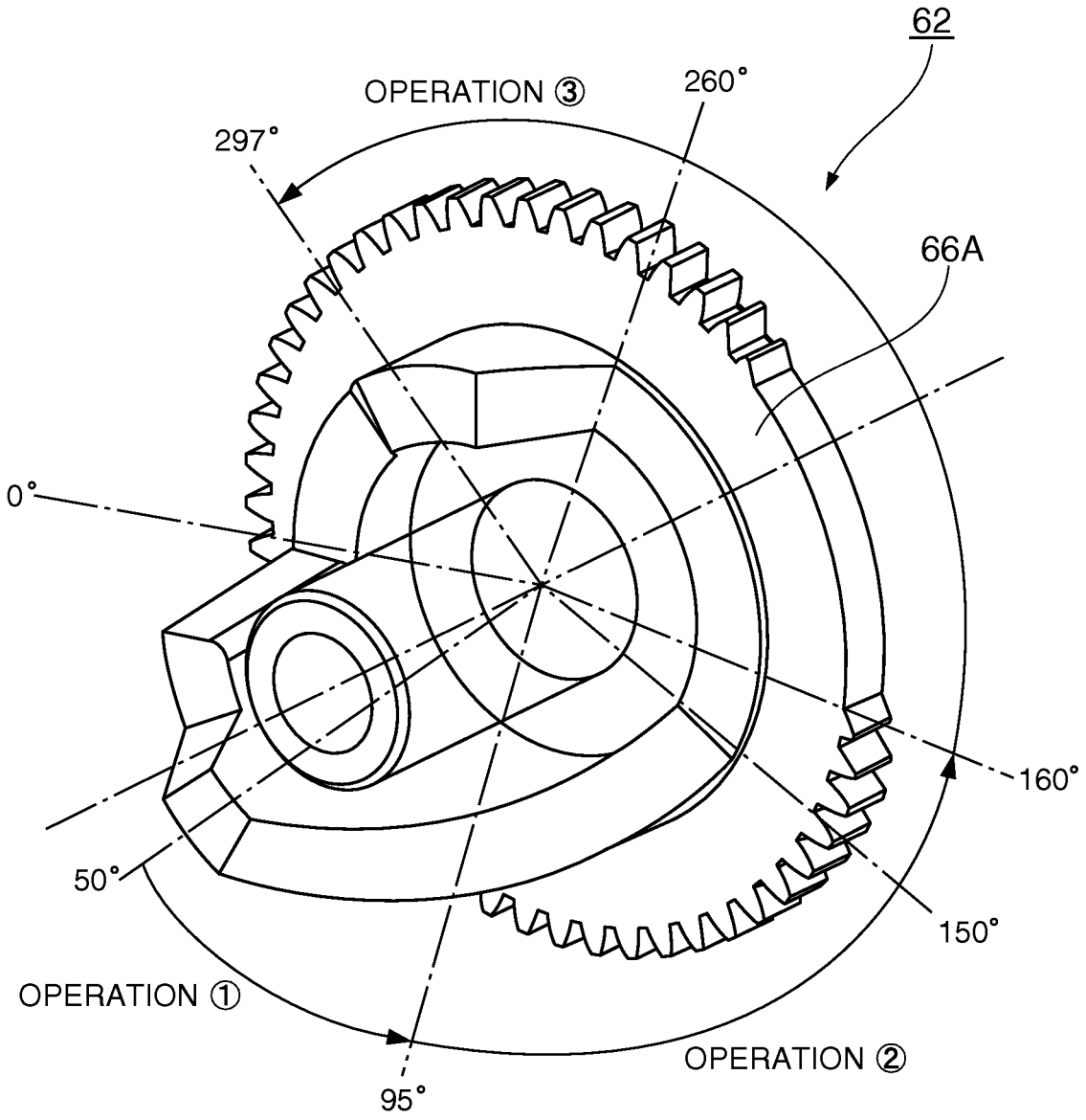
FIG. 13 shows the cam face of the cam groove of the cylindrical cam.
Figure 14:
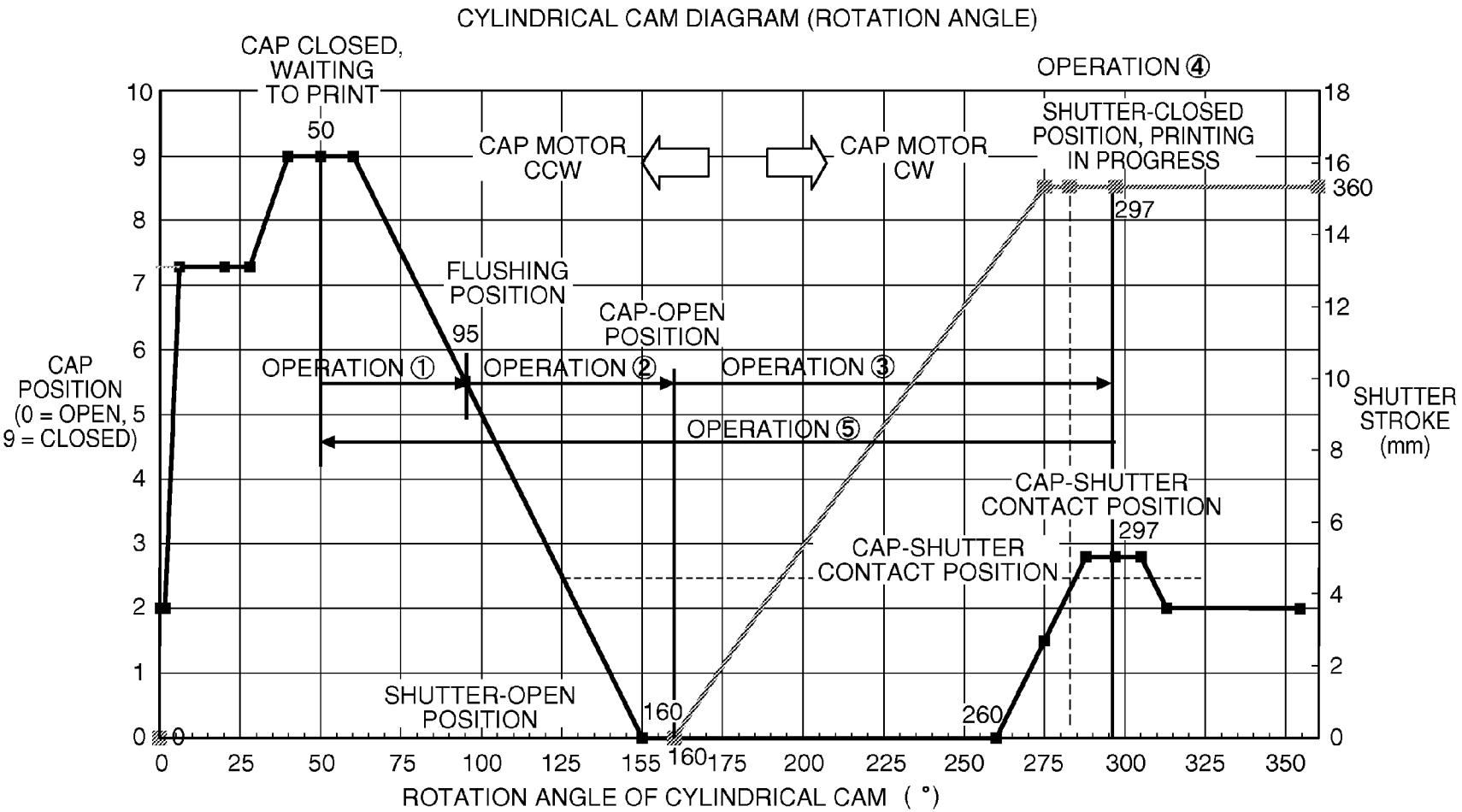
FIG. 14 is a cylindrical cam diagram showing the movement of parts in conjunction with rotation of the cylindrical cam.

FIG. 13 is an oblique view of the cam face 66A that defines the cam groove 66 of the cylindrical cam 62. FIG. 14 is a cylindrical cam diagram showing the position (capping position) of the nozzle cap 52 and the position (shutter stroke) of the shutter 55 according to the rotation angle of the cylindrical cam 62. With the drive control mechanism 60 according to this embodiment of the disclosure, the positions of the nozzle cap 52 and the shutter 55 are determined by the phase (rotation angle) of the cylindrical cam 62. In addition, the position when the cylindrical cam 62 rotates from the origin (rotation angle=0°) clockwise (CW) to 50° is the standby position, and the position at 297° is the printing position.

At the standby position the nozzle cap 52 is in the capping position covering the nozzle surface 51A of the inkjet head 51, and the shutter 55 is in the open position. At the printing position, the shutter 55 is in the closed position and the nozzle cap 52 is in the covered (closed) position in contact with the back of the shutter 55. Note that the retracted position of the nozzle cap 52 is shown in FIG. 14 as "0: open," and the capping position is shown as "9: closed." The position of the shutter 55 indicates the stroke (mm) from the open position to the closed position, the stroke is 0 and the shutter is open at the shutter-open position, and the shutter is closed at the shutter-closed position.

Figure 15:
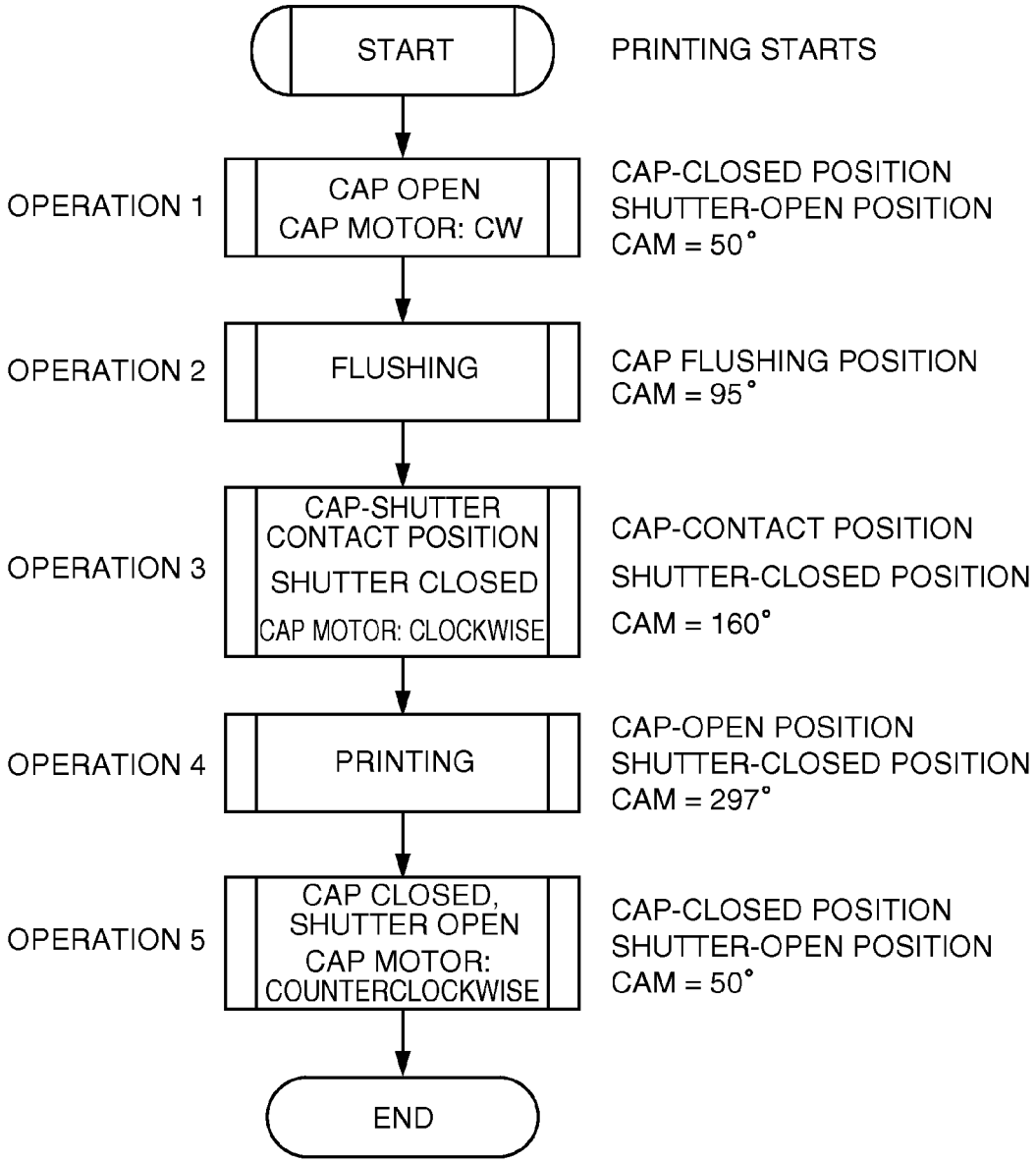
FIG. 15 is a flow chart showing the movement of parts after printing starts.
Figure 16:
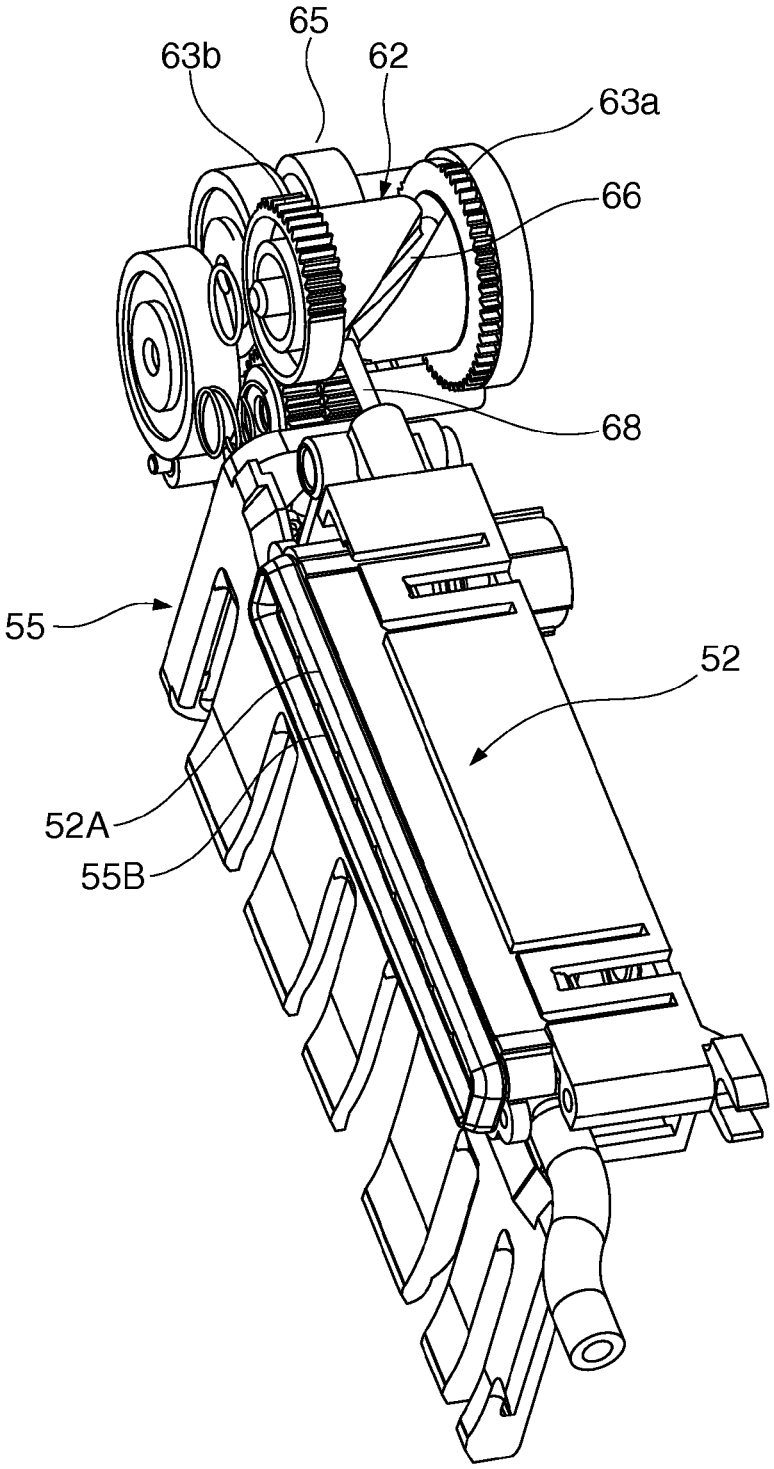
FIG. 16 shows when the cylindrical cam is rotated to 50°.
Figure 17:
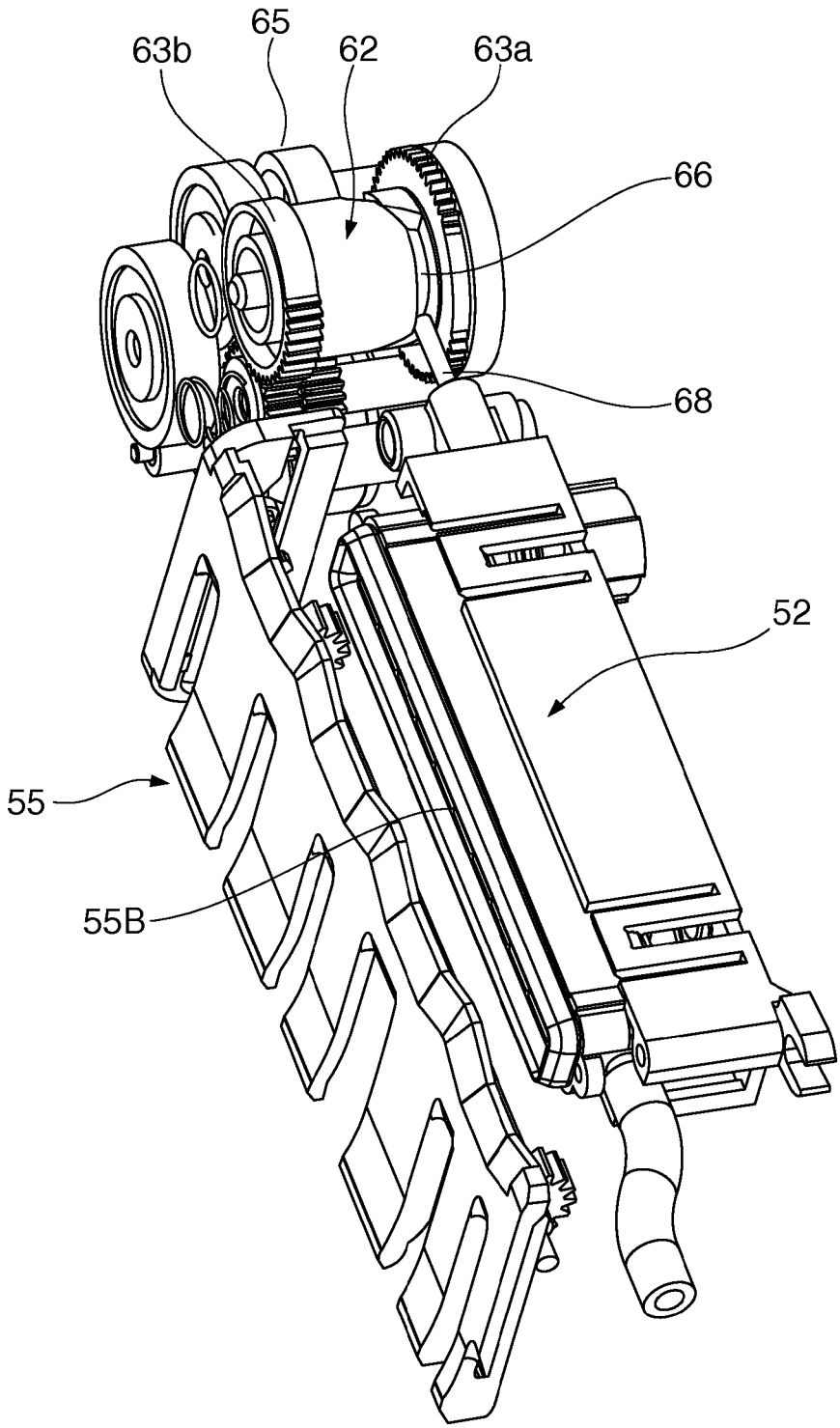
FIG. 17 shows when the cylindrical cam is rotated to 160°.
Figure 18:
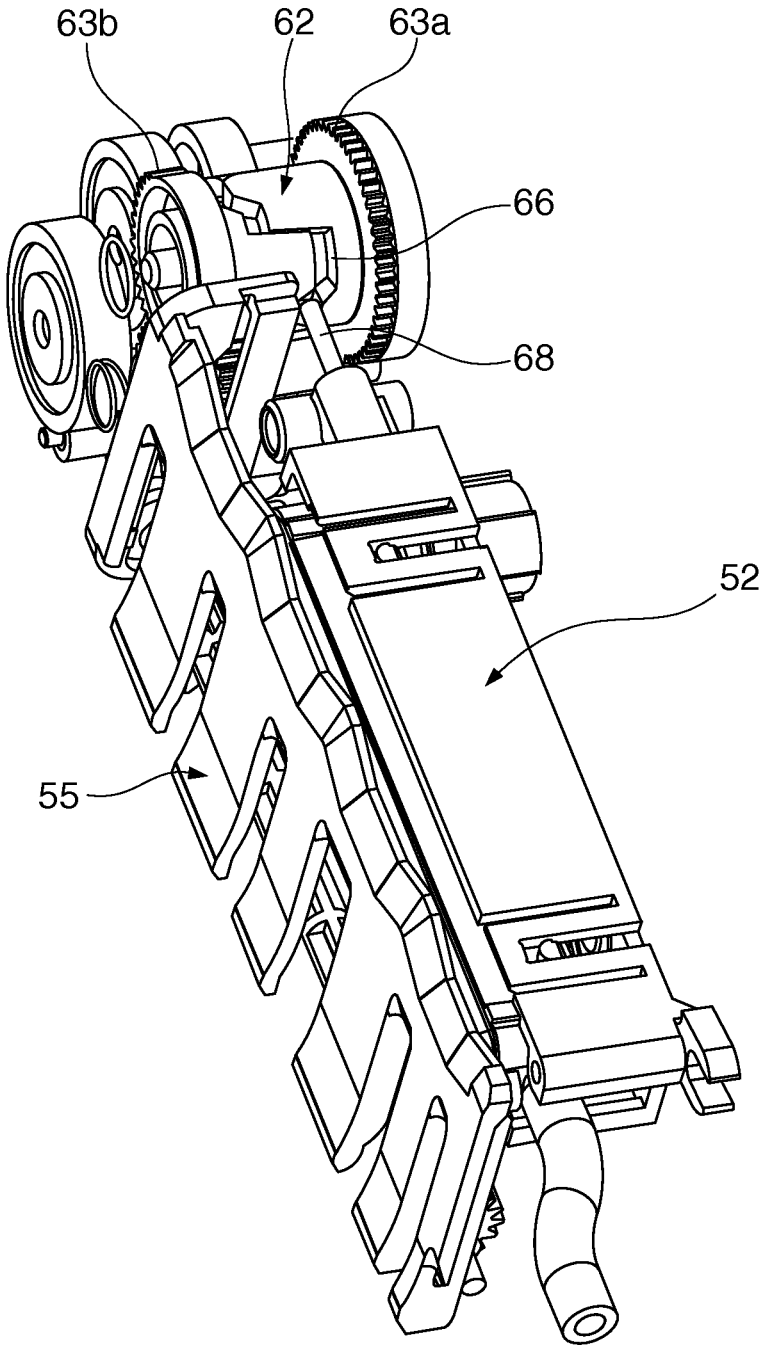
FIG. 18 shows when the cylindrical cam is rotated to 297°.

FIG. 15 is a flow chart showing the operation of parts after printing starts. FIG. 16 shows when the cylindrical cam 62 is rotated to the 50° position, FIG. 17 shows when the cylindrical cam 62 is rotated to the 160° position, and FIG. 18 shows when the cylindrical cam 62 is rotated to the 297° position.

The operation of the parts is described next with reference to the flow chart in FIG. 15.

In the standby mode before printing starts, the cylindrical cam 62 is in the standby position at 50° (see FIG. 16), the nozzle surface 51A of the inkjet head 51 is capped by the nozzle cap 52 (cap-closed position), and the shutter 55 is in the open position (shutter-open position).

When a start printing command is received, such as when the control unit 57 (see FIG. 8 to FIG. 10) receives a start printing command from a host computer, operation 1 starts. As will be understood from FIG. 14, in operation 1 the drive motor 61 drives clockwise (CW) and the cylindrical cam 62 turns from 50° to 95°. As the cylindrical cam 62 turns, the nozzle cap 52 retracts a specific amount from the capping position to the retracted position, and the shutter 55 is held in the open position (shutter-open position).

Operation 2 starts when the cylindrical cam 62 rotates to 95°, and flushing is performed while the cylindrical cam 62 rotates to the 160° position. Flushing is a purging operation that discharges ink droplets from the nozzles of the inkjet head 51 into the nozzle cap 52 to expel ink that has increased in viscosity inside the nozzles and restore defective nozzles to normal working condition. When the cylindrical cam 62 reaches 160°, the nozzle cap 52 reaches the retracted position (cap-open position, see FIG. 17).

Operation 3 starts after the cylindrical cam 62 rotates to 160°. In operation 3, the cylindrical cam 62 rotates from the 160° position to the position at 297°. The nozzle cap 52 is held in the retracted position during operation 3. The shutter 55 slides from the open position to the closed position, and when the cylindrical cam 62 rotates to 275°, the shutter 55 reaches the closed position completely closing the opening 53A of the nozzle cap storage unit 53. From the time the cylindrical cam 62 passes the earlier position at 260°, the nozzle cap 52 advances from the retracted position to the closed nozzle cap position in contact with the back of the shutter 55 in the closed position (cap-contact position, see FIG. 18).

Operation 4 starts after the cylindrical cam 62 rotates to 297°. More specifically, the printing operation is performed, and the inkjet head 51 prints on the back of the check 5 as it passes the printing position.

Operation 5 starts after printing ends. In operation 5, the drive motor 61 turns counterclockwise (CCW), and the cylindrical cam 62 rotates back to the standby position at 50°. As a result, the nozzle cap 52 first retracts from the position in contact with the back of the shutter 55 to the retracted position. Next, the shutter 55 starts sliding from the closed position to the open position. After the shutter 55 reaches the open position, the nozzle cap advances from the retracted position through the opening 53A of the nozzle cap storage unit 53 to the capping position, and returns to the position sealing the nozzle surface 51A of the inkjet head 51 (FIG. 16).

The drive control mechanism 60 according to this embodiment of the disclosure can thus cause both the intermittent gear 63 and cylindrical cam 62 to rotate, and operate the nozzle cap 52 and shutter 55 with a specific synchronization by means of a single drive motor 61. As a result, the nozzle cap drive mechanism 54 and shutter drive mechanism 56 can be compactly constructed.

Figure 19:
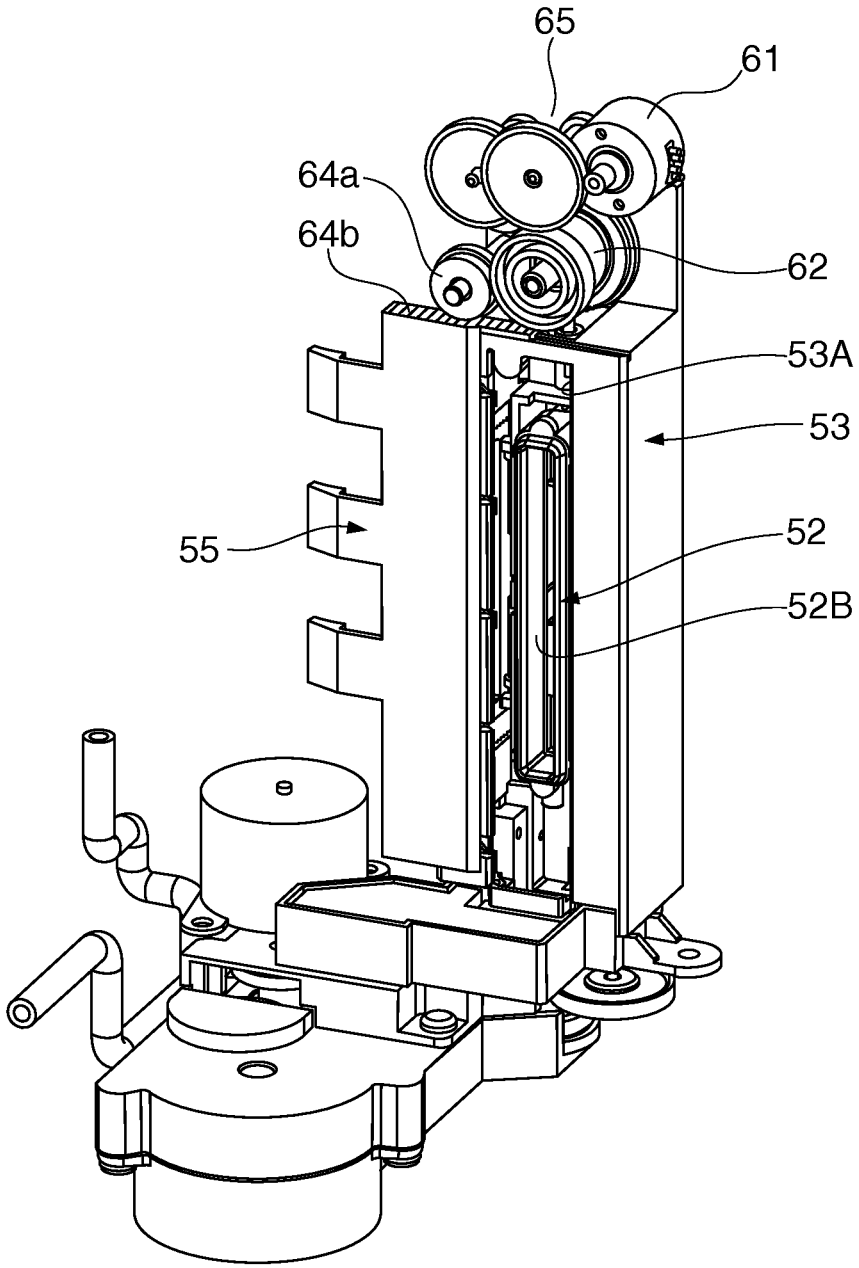
FIG. 19 shows an example of another shutter drive mechanism.

Note that this embodiment of the disclosure rotationally drives and moves the pinions 64*a* along the racks 64*b* formed on the back of the shutter 55 through a pair of bevel gears. Alternatively, as shown in FIG. 19 for example, a rack 64*b* could be formed on the top end of the shutter 55, and a pinion 64*a* meshed with the rack could be directly driven rotationally through a transfer gear train from the intermittent gear 63*b* of the cylindrical cam 62.

It will be obvious that the embodiments of the disclosure may be varied in many ways. Such variations are not to be regarded as a departure from the spirit and scope of the disclosure, and all such modifications as would be obvious to one skilled in the art are intended to be included within the scope of the following claims.

What is claimed is:

1. An inkjet printing device, comprising: an inkjet head;

a media conveyance path configured to convey a recording medium through a printing position of the inkjet head;

a nozzle cap configured to cover a nozzle surface of the inkjet head in a retractable manner across the media conveyance path; and a shutter configured to close an opening portion of the nozzle cap in a retractable manner, wherein the shutter is configured to make a linear reciprocating motion between a closed position to close the opening portion and an open position to open the opening portion, wherein:

at the closed position, the shutter is configured to contact the opening portion of the nozzle cap during advancement of the nozzle cap from a retracted position to a capping position, at the open position, the shutter is configured to not contact the opening portion, the shutter is configured to move in a media conveyance direction of the media conveyance path from the closed position to the open position, and the nozzle cap contacts the shutter at the closed position when the nozzle cap is at an intermediate position during advancement of the nozzle cap from the retracted position to the capping position, so that the opening portion of the nozzle cap is closed by the shutter.

2. The inkjet printing device of claim 1, further comprising:

a media guide disposed opposite to the inkjet head across the media conveyance path, the media guide having a media guide opening formed therein to allow the nozzle cap to advance to and retract from the nozzle surface of the inkjet head, wherein the shutter is configured to cover the media guide opening at the closed position and to guide the recording medium along the media conveyance path.

3. The inkjet printing device of claim 1, wherein a shape of the opening portion open part of the nozzle cap is elongated longer in a width direction of the media conveyance path.

4. The inkjet printing device of claim 1, further comprising:

a drive control mechanism configured to perform a nozzle capping operation using the nozzle cap and a nozzle cap closing operation using the shutter, wherein the drive control mechanism is configured to hold the shutter in the open position when the nozzle cap is in the capping position and while the nozzle cap is moving from the capping position to the retracted position, move the shutter from the open position to the closed position when the nozzle cap is at the retracted position, and when the shutter is at the closed position, advance the nozzle cap until the nozzle cap is brought into contact with the shutter and the opening portion of the nozzle cap is closed by the shutter.

5. The inkjet printing device of claim 4, wherein the drive control mechanism includes a drive motor, a nozzle cap drive mechanism having a cylindrical cam configured to convert a rotation of the drive motor to a linear reciprocating motion of the nozzle cap between the retracted position and the capping position, and a shutter drive mechanism having an intermittent gear and a rack and pinion configured to convert a rotation of the cylindrical cam to the linear reciprocating motion of the shutter between the closed position and the open position according to a position of the nozzle cap.

6. The inkjet printing device of claim 1, wherein the shutter is configured as a solid plate.

7. A method of controlling an inkjet printing device including an inkjet head, a media conveyance path configured to convey in which a recording medium through is passed by a printing position of the inkjet head, a nozzle cap configured to cover that moves from a retracted position opposite a nozzle surface of the inkjet head in a retractable manner across the media conveyance path, and a shutter configured to close that closes an opening portion the open part of the nozzle cap in a retractable manner, the method comprising:

moving the shutter in a media conveyance direction of the media conveyance path: from a closed position where the shutter closes the opening portion to an open position where the shutter opens the opening position, in a linear reciprocating motion between the closed position and the open position; and causing the nozzle cap to contact the shutter at the closed position when the nozzle cap is at an intermediate position during advancement of the nozzle cap from a retracted position to a capping position so that the opening portion open part of the nozzle cap is closed by the shutter.

8. The method of claim 7, wherein the inkjet printing device further includes a drive control mechanism configured to perform a nozzle capping operation using the nozzle cap and a nozzle cap closing operation using the shutter, and the method further comprises, by the drive control mechanism:

holding the shutter in the open position when the nozzle cap is in the capping position and while the nozzle cap is moving from the capping position to the retracted position, moving the shutter from the open position to the closed position when the nozzle cap is at the retracted position, and when the shutter is at the closed position, advancing the nozzle cap until the nozzle cap is brought into contact with the shutter and the opening portion of the nozzle cap is closed by the shutter.

9. The method of claim 7, wherein the shutter is configured as a solid plate.

10. A method of retaining moisture in a nozzle cap for covering a nozzle surface of an inkjet head in a retractable manner, the method comprising:

moving the nozzle cap to a retracted position;

positioning a shutter between the nozzle cap and inkjet head;

advancing the nozzle cap until the nozzle cap is brought into contact with the shutter and an opening portion of the nozzle cap is closed by the shutter;

starting a printing process;

starting, upon completing the printing process, a timer for counting time from the completion of the printing process;

maintaining a relative position of the shutter and the nozzle cap until the counted time reaches a set time; and retracting the nozzle cap, and replacing the nozzle cap on the inkjet head when the counted time reaches the set time, wherein the retracting causes the shutter to open the opening portion of the nozzle cap.

11. The method of claim 10, wherein the starting includes restarting the timer when a subsequent printing process is started before the counted time reaches the set time.

12. The method of claim 10, wherein the closing the shutter includes covering an opening in a media guide to provide a path for a print medium to be conveyed during the printing processes.

13. The method of claim 10, wherein the shutter is configured as a solid plate.

* * * * *